United States Patent [19]

Lowenthal

[11] 4,179,260

[45] Dec. 18, 1979

[54] SMOKERS' LIGHTER

[75] Inventor: Hans Lowenthal, London, England

[73] Assignee: Colibri Lighters Limited, England

[21] Appl. No.: 795,493

[22] Filed: May 10, 1977

[30] Foreign Application Priority Data

May 11, 1976 [GB] United Kingdom ..... 19406/76

[51] Int. Cl.[2] ..... F23Q 7/12

[52] U.S. Cl. ..... 431/255; 431/131

[58] Field of Search ..... 431/130, 131, 132, 150, 431/152, 255

[56] References Cited

U.S. PATENT DOCUMENTS

| | | | |
|---|---|---|---|
| 1,963,345 | 6/1934 | Zwilling | 431/255 |
| 2,978,889 | 4/1961 | Atchley | 431/152 |
| 3,319,129 | 5/1967 | Remy et al. | 431/255 |
| 3,451,761 | 6/1969 | Bross | 431/131 |
| 3,741,714 | 6/1973 | Yoshinaga | 431/255 |
| 4,076,491 | 2/1978 | Mohr | 431/130 |

FOREIGN PATENT DOCUMENTS 1456455 11/1976 United Kingdom .

*Primary Examiner*—Carroll B. Dority, Jr.

*Attorney, Agent, or Firm*—Robert E. Burns; Emmanuel J. Lobato; Bruce L. Adams

[57] ABSTRACT

A lighter utilizing a piezoelectric spark ignition system comprises a casing composed of a casing body having hinged at one end a casing lid for opening and closing the casing. A fuel reservoir tank having a burner at its upper end is mounted within the casing body adjacent the end of the casing remote from that at which the casing lid is hinged. A piezoelectric spark generating unit is mounted in the casing body adjacent the end at which the casing lid is hinged and is situated side by side with the fuel reservoir tank. The piezoelectric unit is actuated in response to manually depressing an actuating member mounted along one of the sides of the casing. The burner and actuating member are situated at the upper part of the casing and are substantially concealed beneath the casing lid when the lid is in its closed position. The burner and actuating member are exposed for use upon upward swinging movement of the casing lid from its closed position.

18 Claims, 18 Drawing Figures

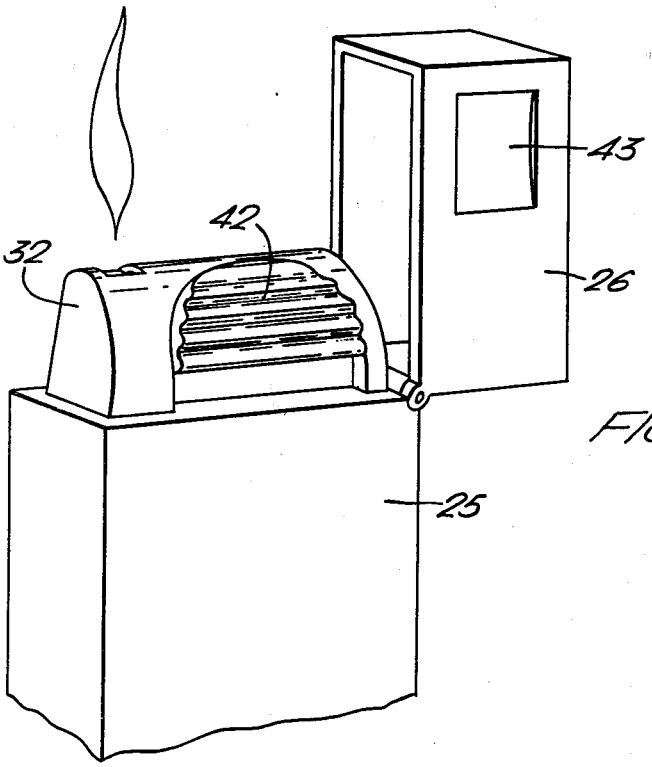
FIG. 7.
FIG. 11
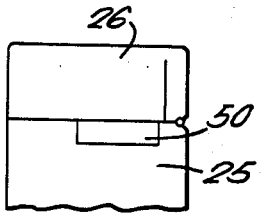
FIG. 12.
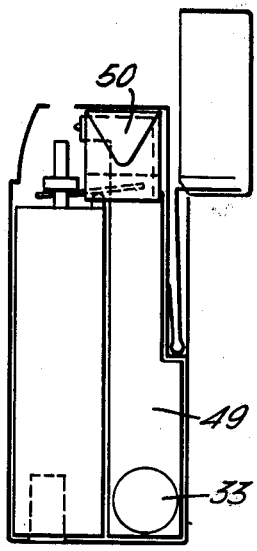

FIG. 13.
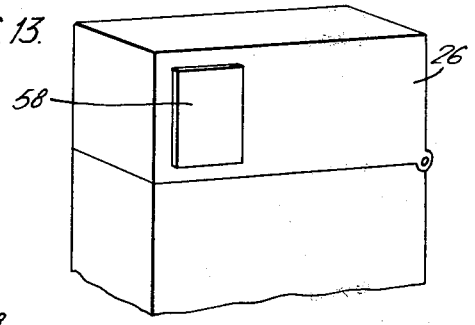
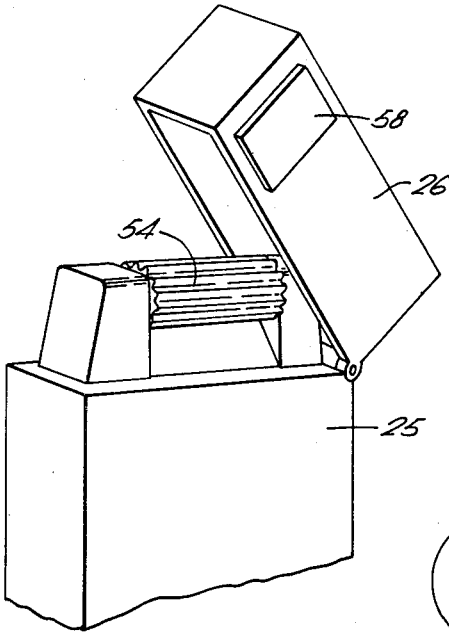
FIG. 14.
FIG. 15.
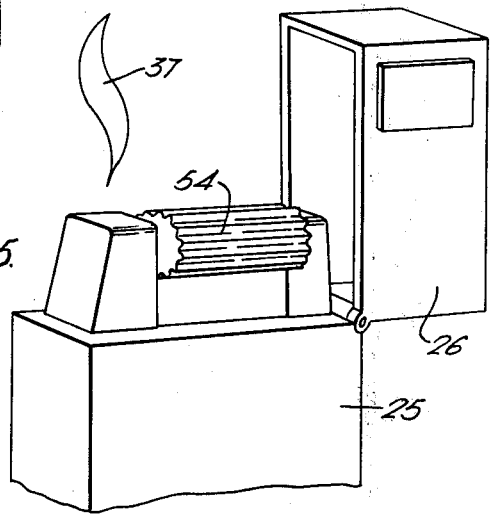

SMOKERS' LIGHTER

BACKGROUND OF THE INVENTION

The invention relates to a smokers' lighter of the so called "box-type", that is the type having a substantially rectangular casing of elongate horizontal cross section and the upper part of which is constituted by a lid which is connected to the remainder of the casing so that the lid may be swung upwards generally adjacent to a narrower edge of the casing. In order to operate the lighter the lid is first swung upwards to expose the burner, after which an actuating member is actuated manually to operate an ignition system.

Modern lighters are gas burning and the predominant trend for some fifteen years has been for the gas to be ignited by a discharge adjacent to the burner of an electric spark derived either from a piezoelectric unit or from a battery energised circuit within the lighter. In a box-type lighter the raising of the lid conventionally opens the gas valve and the electrical ignition system is then operated by actuating a piezoelectric mechanism, or a button or other switch member in the case of a battery energised circuit. It has been customary for these actuating members to be adjacent to the narrower edge of the lighter casing remote from the lid hinge, particularly when, to avoid accidental operation of the ignition system, the actuating member is only exposed for operation or made operational when the lid has been raised. This positioning of the actuating member has been inconvenient. It requires the burner to be situated nearer to the lid hinge and hence adjacent to the lid so that the flame is not as readily accessible for use as would be desirable, or the actuating linkage has to by pass the gas tank or burner valve.

SUMMARY OF THE INVENTION

In accordance with the present invention, in a gas burning smokers' lighter of the box-type having an electrical spark ignition system, a burner is disposed adjacent to the narrower edge of the lighter casing remote from the edge about which the lid swings upwards, and the ignition system is operable, after raising of the lid, by an actuating member at a broader side of the lighter casing, the actuating member being at least partially covered by the lid when the lid is closed.

With this construction the lighter can be operated by applying the operator's thumb to the actuating member at the broader side of the lighter at a position, as seen perpendicularly to the broader side of the lighter, generally spaced between the burner and the lid. The flame is then produced at the narrower edge of the lighter remote from the lid where it is most useful for application to a cigarette or pipe to be lit and the burner valve mechanism and ignition system can be distinct and separate.

Inadvertant actuation of the ignition system is effectively precluded if at least that part of the actuating member which must be contacted by the operator to operate the ignition system is only exposed after raising of the lid. Indeed, reasons for aesthetic reasons the actuating member is preferably concealed when the lid is closed.

The lid is preferably shaped on a broader side of the lighter casing to facilitate the raising of the lid by an operator's thumb. This is particularly useful when the lighter is capable of being operated only at one broader side in which case the shaping will preferably be unique to that broader side. The shaping simplifies the complete operation of the lighter by the thumb of the operator's hand in which the lighter is held, by first raising the lid using the thumb, and subsequently applying the thumb to the actuating member. When the shaping is unique to one broader side of the lid at which the actuating member is accessible, it naturally follows that when the lighter is handled, the operator instinctively knows by feel how the lighter should be held so that the lid may be raised and the actuating member readily operated by his thumb. The shaping may be a projection or projections, serrations, or a depression or depressions in the side of the lid. It may also take the form of a conventional initial shield.

The actuating member may be an actuating plunger of a piezoelectric ignition system. In this case the actuating plunger may be broader than would be possible if it were positioned at a narrower side of the casing, thereby resulting in a "softer" feeling. Alternatively, the actuating member may be a switch actuator connected in a battery energised ignition circuit, such as a mechanical switch, or an electric contact switch connected in a battery energised ignition circuit and so exposed in use that the ignition system is most naturally operated by creation of a short circuit between the contact and the casing by bridging by the operator's thumb. The actuating member, or a separate actuating member, may be used to open the gas burner valve, especially in the case of a piezoelectric ignition system, but preferably the gas burner valve is opened by the operation of raising the lid, particularly when the actuating member is an exposed contact for a short circuit connection or is an actuating member for another battery energised type of ignition system.

The various features referred to above may be used in any appropriate combination with one another.

The new construction is inexpensive, simple and reliable, and leads to simple servicing as the actuating member may extend directly from the ignition system.

BRIEF DESCRIPTION OF THE DRAWINGS

Some examples of lighters constructed in accordance with the present invention are illustrated in the accompanying drawings in which:

FIGS. 7, 8 and 9; and FIGS. 10, 11, and 12 are views similar to FIG. 1 to 3 but of second, third, and fourth lighters respectively;

FIG. 13 is a perspective view of the upper part of a fifth lighter prior to operation;

FIG. 14 is a view similar to FIG. 13 but showing the lid partially raised;

FIG. 15 is a view similar to FIGS. 13 and 14 but showing the lid fully raised and the lighter operated;

DETAILED DESCRIPTION OF PREFERRED EMBODIMENTS

Figure 1:
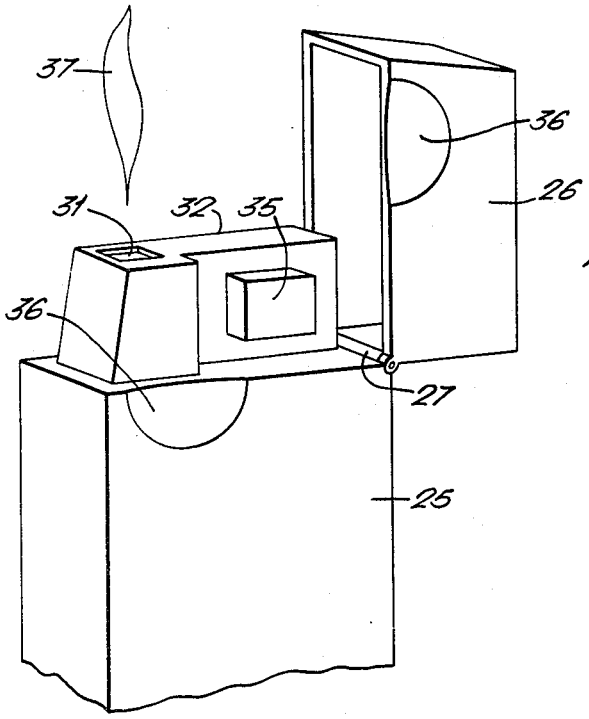
FIG. 1 is a perspective view of the upper part of one lighter upon operation.
Figure 2:
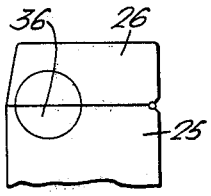
FIG. 2 is a side elevation of the upper part of the FIG. 1 lighter prior to operation.
Figure 3:
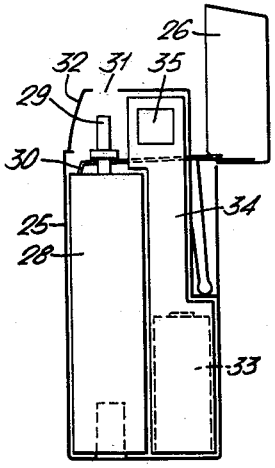
FIG. 3 is a diagrammatic side elevation of the FIG. 1 lighter showing the lid raised and with the front part of the casing omitted to show the interior parts.

The lighter shown in FIGS. 1 to 3 has, like the other examples, a rectangular box-shaped casing comprising a casing body 25 and a casing lid 26 hinged to the body along a narrower edge by a hinge 27. The hinge 27 might be replaced by some other form of pivotal connection, such as pivotal links, which causes the lid 26 to swing upwards generally about its narrower edge relatively to the body 25.

The body 25 contains a gaseous fuel reservoir 28 provided with a burner 29 which is exposed when the lid 26 is raised. Raising of the lid 26 raises the burner 29 through a lever 30 and opens the valve to discharge fuel gas through an opening 31 in a block 32 which is exposed upon opening of the lid.

The casing body 25 also houses a 12 volt battery 33 and a spark generating unit 34 which is energised by the battery and operated by a press button actuating member 35 which operates a microswitch. The spark generating unit operates in conventional manner and will not be described in this specification.

As shown in FIGS. 1 and 2, the casing body 25 and lid 26 are each provided with one half of a circular dish shaped thumb depression 36 which is unique to the broader side of the lighter visible in FIGS. 1 and 2.

In operation the operator holds the casing body 25 in the palm of the hand, applies the thumb to the depression 36 and pushes upwards to raise the lid 26 and open the burner valve. The actuating member 35 is only then exposed between the burner and lid and upon depression causes the discharge of a spark between electrodes (not shown) adjacent to the burner 29 to ignite the flame shown in FIG. 1 at 37. It will be appreciated that this flame is adjacent to the narrow end of the lighter remote from the hinge 26 where it is readily accessible for use.

Figure 4:
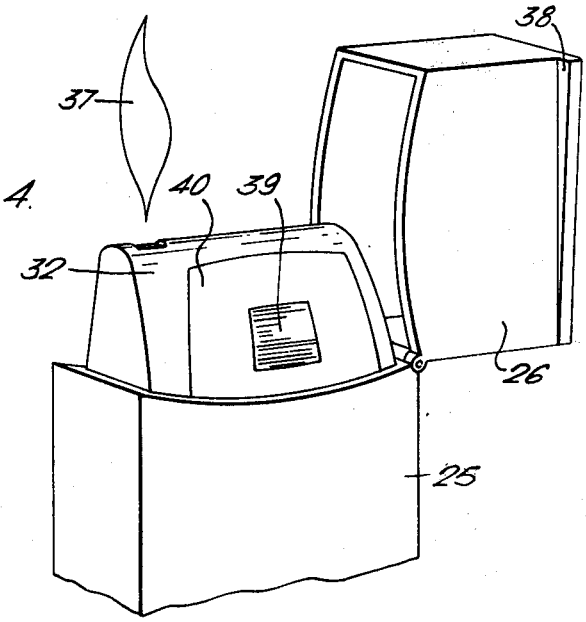
FIGS. 4, 5, and 6.
Figure 5:
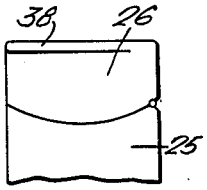
Figure 6:
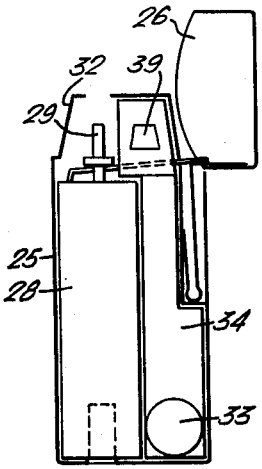

The second lighter, illustrated in FIGS. 4 to 6, is similar to the first example and analogous parts are given similar reference numerals in this and subsequent examples. In this example the lower edge of the lid 26 abuts the upper edge of the casing body 25 across a curved plane, as distinct from a flat plane. Also, instead of the thumb depression 36, the lid 26 is, in this case, provided on the side visible in FIGS. 4 and 5 with a protruding ledge 38 to facilitate raising of the lid. The block 32 is of a different shape than that of the first example and instead of carrying a switch button 35, it carries an exposed switch contact 39 which is surrounded by a body of insulating material 40. The spark generating unit 34, which is energized by a 1.5 volt battery 33, is operated to discharge a spark adjacent to the burner 29 upon a short circuit being produced between the contact 39 and casing, most naturally by the operator's thumb after the lid 26 has been raised to expose the contact 39. The spark generating unit again incorporates conventional circuitry which need not be described here.

Figure 8:
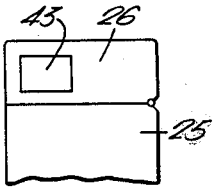
Figure 9:
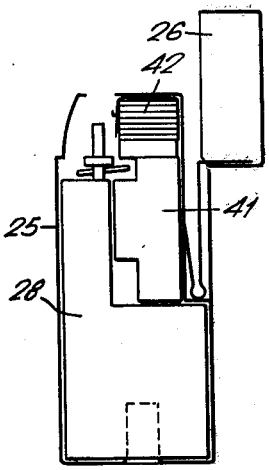

The third example illustrated in FIGS. 7 to 9 differs from the earlier examples in the use of a larger fuel reservoir 28 and, instead of a battery energised spark generating unit 34, an impact piezoelectric spark generating unit 41. Again such units are well known and will not be described here. Upon opening of the lid 26, actuating means comprising a depressible actuating member 42 in the form of a serrated plunger is exposed and an ignition spark is produced from the generator 41 by pressing the plunger 42 downwards. The plunger 42 has serrations along its top and at least part way down along its side and the serrations are suitably shaped so as to make engagement with the operator's thumb when pressed thereagainst and drawn downwardly to thereby actuate the piezoelectric spark generating unit 41. Reference is made hereinafter to the serrations as simply being 'in the side' of the plunger and such reference means plunger serrations which are visible when viewing the lighter in side elevation, such as shown, for example, in the side elevation view of FIG. 9. As evident from FIG. 9, the depressible member 42 is mounted atop the piezoelectric spark generating unit 41 thereby facilitating manufacture and assembly of the lighter as well as removal and replacement of the generating unit—depressible member assembly. This is likewise the case with the fuel reservoir 28 and the burner 29 mounted atop the reservoir, and the reservoir-burner assembly can be removed and replaced together as a unit. Instead of the thumb depression 36 or ridge 38, the lid has, on the broad side visible in FIGS. 7 and 8, an initial shield 43 which facilitates raising of the lid by the operator's thumb.

Figure 10:
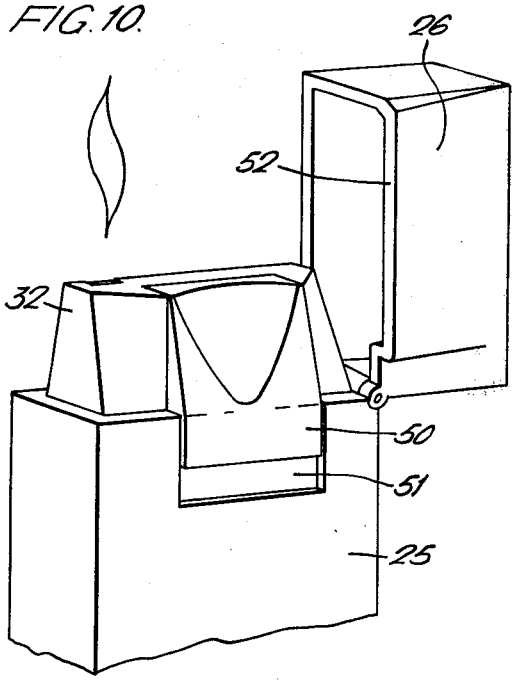
Figure 16:
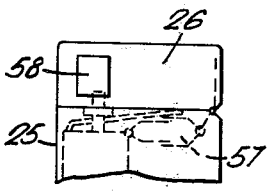
FIG. 16 is a diagrammatic side elevation of the upper part of the FIG. 13 lighter with the lid closed.

In the fourth example illustrated in FIGS. 10 to 12, a spark generator 49 energised by a 1.5 volt battery 33 is used to produce the ignition spark and is operated upon depression of a plunger 50 which is partly exposed at all times in a slot 51 in the upper edge of the casing body 25 but which is not fully exposed so that a downward pressure can be applied to operate the unit 49 until the lid 26 has been raised. The plunger 50 has an indentation in its side so shaped as to make engagement with the operator's thumb when pressed thereagainst and drawn down the side of the lighter casing so that upon depression, the plunger 50 closes a switch which has a similar effect to the production of the bridging short circuit between the contact 39 and casing in the second example. In this fourth example the broader side of the lid, which is visible in FIGS. 10 and 11, is flared outwards to provide an overhang 52 to facilitate raising of the lid by the operator's thumb.

Figure 17:
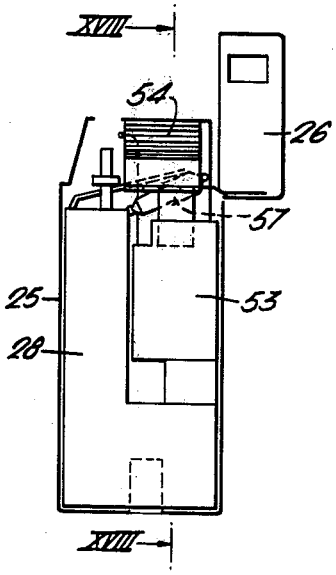
FIG. 17 is a view similar to FIG. 3 but of the FIG. 13 lighter; and, FIG. 18 is a diagrammatic section taken on the line XVIII—XVIII in FIG. 17.
Figure 18:
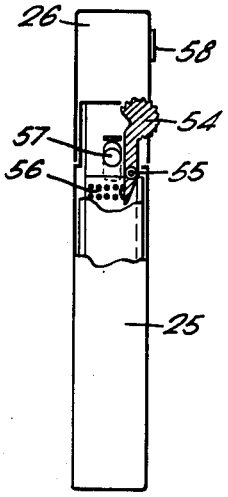

The fifth example illustrated in FIGS. 13 to 18 is provided with a conventional impact piezoelectric spark generating unit 53 which is operated by depression of actuating means comprising a serrated depressible actuating member 54 which has serrations in the side thereof as shown in the side elevation view of FIG. 17. The actuating member 54 is only exposed when the lid 26 is opened and is pivotally mounted about a hinge 55. A compression spring 56 acts on a portion of the actuating member below the hinge 55 tending to urge the serrated part of the actuating member to the left as seen in FIG. 18, that is into the confines of the casing. When the lid is open, the lid causes a cam member 57 to swing upwards, and ride over a surface of the actuating member, causing it to pivot against the action of the spring 56, from the FIG. 14 to the FIGS. 15 and 18 position, in which it overhangs the broader side of the casing body 25 and is more readily accessible for application of the operator's thumb. In this example the lid is provided uniquely on the operating broader side with a rectangular initial shield projection 58 for facilitating opening of the lid by the operator's thumb.

I claim:

1. A smokers' lighter of the boxtype comprising: a substantially rectangular casing of elongate horizontal cross section having a pair of narrower opposed ends separated by a pair of relatively broader sides with an upper part of said casing constituted by a lid; means connecting said lid to said casing whereby said lid may be swung upwards generally adjacent to one narrower end thereof; a fuel reservoir tank having a burner at the upper end thereof and mounted within said casing adjacent to the other narrower end of said casing remote from said one end about which said lid swings upwards whereby said burner is exposed for use upon upward swinging of said lid; and a piezoelectric spark generating unit having a depressible actuating plunger at the upper end thereof and mounted side by side with said fuel reservoir tank within said casing and adjacent to said one narrower end of said casing about which said lid swings upwards, said actuating plunger being mounted to be depressed by an operator's thumb applied at one broader side of said casing and having an indentation in its side so shaped as to make engagement with the operator's thumb when pressed thereagainst and drawn down said one broader side of said casing to thereby operate said spark generating unit and being mounted such that at least that part thereof which must be contacted by the operator to depress said plunger becomes exposed for use only upon raising of said lid.

2. A lighter according to claim 1; wherein said actuating plunger is mounted to be depressed substantially vertically downwards into said casing to operate said spark generating unit.

3. A lighter according to claim 2; wherein said actuating plunger extends along one broader side of said casing.

4. A lighter according to claim 3; wherein the upper edge of said actuating plunger adjacent to said broader side of said lighter is chamfered.

5. A lighter according to claim 1; wherein said actuating plunger is mounted so as to be concealed when said lid is closed.

6. A lighter according to claim 1; wherein said lid is shaped on a broader side of said casing so as to facilitate the raising of said lid.

7. A lighter according to claim 6; wherein said lid is shaped so as to facilitate the raising of said lid on said broader side of said casing at which said actuating plunger isaccessible in use.

8. A lighter according to claim 1;wherein said casing immediately below said lid is shaped on a broader side thereof so as to facilitate the raising of said lid.

9. A lighter according to claim 8; wherein said casing immediately below said lid is shaped so as to facilitate the raising of said lid on said broader side of said casing at which said actuating plunger is accessible in use.

10. In a lighter of the type having a casing comprised of a casing body of elongate horizontal cross section and a casing led pivotally connected to the upper part of said casing body at one end thereof for upward pivotal movement from a normally closed position closing said casing to an open position opening said casing; a fuel reservoir tank disposed within said casing body adjacent the other end thereof and having at its upper end a burner for burning fuel, said burner being disposed proximate the casing body other end remote from said one end at the upper part of said casing such that upward pivotal movement of said casing lid from its closed position exposes said burner for use; a piezoelectric spark generating unit mounted within said casing body adjacent said one end thereof in side-by-side relationship with said fuel reservoir tank and operable when actuated for generating a spark to ignite the fuel for burning by said burner; actuating means including a depressible member diposed along one of the sides of said casing body between said ends an operative in response to manual depression of said depressible member by an operator's thumb for actuating said piezoelectric spark generating unit, said depressible member having serrations in its side so shaped as to make engagement with the operator's thumb when pressed thereagainst and drawn downwardly to actuate said piezoelectric spark generating unit; and means mounting said depressible member at the upper part of said casing at a location above said piezoelectric spark generating unit such that said casing lid, when in its closed position, substantially conceals said depressible member beneath said casing lid thereby effectively precluding actuation thereon and upward pivotal movement of said casing lid from its closed position exposes said depressible member for accessible actuation.

11. A lighter according to claim 10; wherein said means mounting said depressible member comprises means mounting said depressible member atop said piezoelectric spark generating unit.

12. A lighter according to claim 11; including means mounting said burner atop said fuel reservoir tank.

13. A lighter according to claim 10; further including means comprising a depression in said casing along one of the sides thereof for facilitating manual upward pivotal movement of said casing lid from its closed position.

14. A lighter according to claim 10; further including means comprising a protrusion on said casing along one of the sides thereof for facilitating manual upward pivotal movement said casing lid from its closed position.

15. A lighter according to claim 10; wherein said means mounting said depressible member includes means mounting said depressible member for movement between an inward position in which said depressible member is situated beneath said casing lid and an outward position in which said depressible member projects outwardly of a said casing in readiness for actuation; and means for effecting movement of said depressible member between said inward and outward positions in response to manual movement of said casing lid between its open and closed positions.

16. A lighter according to claim 10; wherein said depressible member is dimensioned so as to extend only part way across the width of said casing between the casing sides.

17. A smoker's lighter of the box-type comprising: a substantially rectangular casing of elongate horizontal cross section having a pair of narrower opposed ends separated by a pair of relatively broader sides with an upper part of said casing constituted by a lid; means connecting said lid to said casing whereby said lid may be swung upwards generally adjacent to one narrower end thereof; a fuel reservoir tank having a burner at the upper end thereof and mounted within said casing adjacent to the other narrower end of said casing remote from said one end about which said lid swings upwards whereby said burner is exposed for use upon upward swinging of said lid; a piezoelectric spark generating unit having a depressible actuating plunger at the upper end thereof and mounted side by side with said fuel reservoir tank within said casing and adjacent to said one narrower end of said casing about which said lid swings upwards, said actuating plunger being mounted to be depressed by an operator's thumb applied at one broader side of said casing to thereby operate said spark generating unit and being mounted such that at least that part thereof which must be contacted by the operator to depresssaid plunger becomes exposed for use only upon raising of said lid; means mounting said actuating plunger for outward movement with respect to said casing; and means connecting said actuating plunger to said lid whereby when said lid is raised said actuating plunger is moved in a direction outwwardly of said casing to a more accessible position.

18. In a lighter of the type having a casing comprised of a casing body of elongate horizontal cross section and a casing lid pivotally connected to the upper part of said casing body at one end thereof for upward pivotal movement from a normally closed position closing said casing to an open position opening said casing: a fuel reservoir tank disposed within said casing body adjacent the other end thereof and having at its upper end a burner for burning fuel, said burner being disposed proximate the casing body other end remote from said one end at the upper part of said casing such that upward pivotal movement of said casing lid from its closed position exposes said burner for use; a piezoelectric spark generating unit mounted within said casing body adjacent said one thereof is side-by-side relationship with said fuel reservoir tank and operable when actuated for generating a spark to ignite the fuel for burning by said burner; actuating means including a depressible member disposed along one of the sides of said casing body between said ends and operative in response to manual depression of said depressible member by an operator's thumb for actuating said piezoelectric spark generating unit; means mounting said depressible member at the upper part of said casing at a location above said piezoelectric spark generating unit such that said casing lid, when in its closed position, substantially conceals said depressible member beneath said casing lid thereby effectively precluding actuation thereof and upward pivotal movement of said casing lid from its closed position exposes said depressible member for accessible actuation, said means including means mounting said depressible member for movement between an inward position in which said depressible member is situated beneath said casing lid and an outward position in which said depressible member projects outwardly of said casing in readiness for actuation; and means for effecting movement of said depressible member between said inward and outward positions in response to manual movement of said casing lid between its open and closed positions.

* * * * *